US012075936B2

(12) United States Patent
Voegel

(10) Patent No.: US 12,075,936 B2
(45) Date of Patent: Sep. 3, 2024

(54) NECK PILLOW WITH ATTACHED BLANKET

(71) Applicant: John Voegel, Missoula, MT (US)

(72) Inventor: John Voegel, Missoula, MT (US)

( * ) Notice: Subject to any disclaimer, the term of this patent is extended or adjusted under 35 U.S.C. 154(b) by 252 days.

(21) Appl. No.: 17/852,204

(22) Filed: Jun. 28, 2022

(65) Prior Publication Data

US 2023/0414015 A1 Dec. 28, 2023

(51) Int. Cl.
*A47G 9/10* (2006.01)
*A47C 7/38* (2006.01)
*A47G 9/02* (2006.01)

(52) U.S. Cl.
CPC ..... *A47G 9/1045* (2013.01); *A47C 7/383* (2013.01); *A47G 9/0223* (2013.01)

(58) Field of Classification Search
CPC ..... A47C 7/383; A47G 9/0223; A47G 9/10
See application file for complete search history.

(56) References Cited

U.S. PATENT DOCUMENTS

| | | | | |
|---|---|---|---|---|
| 3,863,283 | A | 2/1975 | Mohr | |
| 7,131,156 | B1 | 11/2006 | Walker-Craft | |
| 7,513,001 | B1 | 4/2009 | Leach | |
| 7,779,492 | B2 | 8/2010 | Mangano | |
| 7,900,303 | B2 | 3/2011 | Mastrosimone-Gese | |
| 9,737,158 | B2 | 8/2017 | Kreppein | |
| 10,292,508 | B1 * | 5/2019 | Kim | A47G 9/1081 |
| 10,390,623 | B2 * | 8/2019 | Konigsberg | A47G 9/066 |
| 10,945,544 | B2 | 3/2021 | Lee | |
| 11,033,129 | B2 | 6/2021 | Diaz | |
| 2002/0166173 | A1 * | 11/2002 | Brown | A47G 11/001 5/639 |
| 2009/0133192 | A1 * | 5/2009 | Hassell | A47C 7/383 5/639 |
| 2012/0144550 | A1 | 6/2012 | Nejad | |
| 2013/0125312 | A1 | 5/2013 | Harooni | |
| 2014/0000036 | A1 * | 1/2014 | Cohen | A47C 27/081 5/639 |
| 2015/0320244 | A1 | 11/2015 | Li | |
| 2015/0366382 | A1 | 12/2015 | Ostolaza-Torres | |
| 2016/0183685 | A1 | 6/2016 | Kang | |
| 2016/0302596 | A1 | 10/2016 | Ross et al. | |
| 2017/0000273 | A1 | 1/2017 | Mitchell | |
| 2018/0310731 | A1 * | 11/2018 | Staton | A47G 9/0253 |
| 2018/0325292 | A1 * | 11/2018 | Kassab Arabo | A47C 7/383 |
| 2019/0231100 | A1 * | 8/2019 | Pietracatella | A47C 7/383 |
| 2020/0128980 | A1 * | 4/2020 | Hanifi | A47G 9/1081 |
| 2020/0253397 | A1 * | 8/2020 | Diaz | A47C 7/383 |
| 2021/0353083 | A1 * | 11/2021 | Ali | F21V 33/0004 |
| 2022/0117397 | A1 * | 4/2022 | Scaparotti | A47G 9/1081 |

FOREIGN PATENT DOCUMENTS

| | | | | |
|---|---|---|---|---|
| CN | 204015805 U | * | 12/2014 | |
| JP | 3218875 U | * | 11/2018 | |
| WO | WO-2015041384 A1 | * | 3/2015 | A47C 7/383 |
| WO | WO-2017205428 A1 | * | 11/2017 | |

* cited by examiner

*Primary Examiner* — Eric J Kurilla
(74) *Attorney, Agent, or Firm* — Armstrong Teasdale LLP

(57) ABSTRACT

In yet another aspect, a pillow generally comprises a blanket, a top, a bottom, and sides extending between the top and the bottom. The blanket is attached to the sides and has a stowed position and a use position. The top, the bottom, and the sides collectively define a first compartment sized to receive stuffing. The top defines a second compartment sized to receive the blanket in a stowed position.

15 Claims, 11 Drawing Sheets

NECK PILLOW WITH ATTACHED BLANKET

BACKGROUND

The field of the disclosure relates generally to neck pillows, and, more specifically, to a neck pillow with an attached blanket and integrated storage compartment.

Neck pillows are compact, portable pillows that can be used for comfort while traveling. For example, some neck pillows are shaped to rest on a user's shoulders and extend around their neck. The neck pillows are filled with a soft material (e.g., stuffing) that provides a cushion around the user's neck and head. Such neck pillows may be used to comfort and support the neck and head while in a seated position for extended periods of time.

Also, people may bring a blanket or other comfort item with them while traveling. However, the blanket may be bulky and difficult to carry. In addition, the blankets may be hard to stow when not in use. For example, the blankets may need to be folded or bundled and stowed in a bag or luggage.

Accordingly, there is a need for a neck pillow with an attached blanket that is easy to stow, quick to deploy, and provides sufficient comfort for a user.

BRIEF DESCRIPTION

In one aspect, a pillow generally comprises a cover, stuffing, and a blanket. The cover has a first leg, a second leg, and a bend connecting the first leg to the second leg. The first leg and the second leg each have a proximal end joined to the bend and a free distal end opposite the proximal end. The first leg, the second leg, and the bend collectively form a U-shape and define a first compartment and a second compartment. The stuffing is disposed within the first compartment and extends through the first leg, the second leg, and the bend. The blanket is attached to the cover. The free distal end of at least one of the first leg and the second leg defines at least one opening into the second compartment. The blanket has a stowed position in which the blanket extends from an outer surface of the cover and into the second compartment through the opening. The second compartment is sized to receive the blanket in the stowed position.

In another aspect, a pillow includes a cover including a top, a bottom, and sides extending between the top and the bottom. The cover is U-shaped and the top, the bottom, and the sides collectively define a first compartment. The top defines a second compartment. The pillow also includes stuffing disposed within the first compartment, and a blanket attached to the sides of the cover. The blanket has a stowed position in which the blanket extends from the sides of the cover and into the second compartment. The second compartment is sized to receive the blanket in the stowed position.

In yet another aspect, a pillow generally comprises a blanket, a top, a bottom, and sides extending between the top and the bottom. The top, the bottom, and the sides collectively define a first compartment sized to receive stuffing. The top defines a second compartment sized to receive the blanket in a stowed position. The top is a constructed of a material that includes spandex and is elastic. The top is configured to secure the blanket within the second compartment without fasteners.

DETAILED DESCRIPTION

As used herein, an element or step recited in the singular and preceded with the word "a" or "an" should be understood as not excluding plural elements or steps, unless such exclusion is explicitly recited. Furthermore, references to "example" or "one implementation" of the present disclosure are not intended to be interpreted as excluding the existence of additional implementations that also incorporate the recited features.

Figure 1:
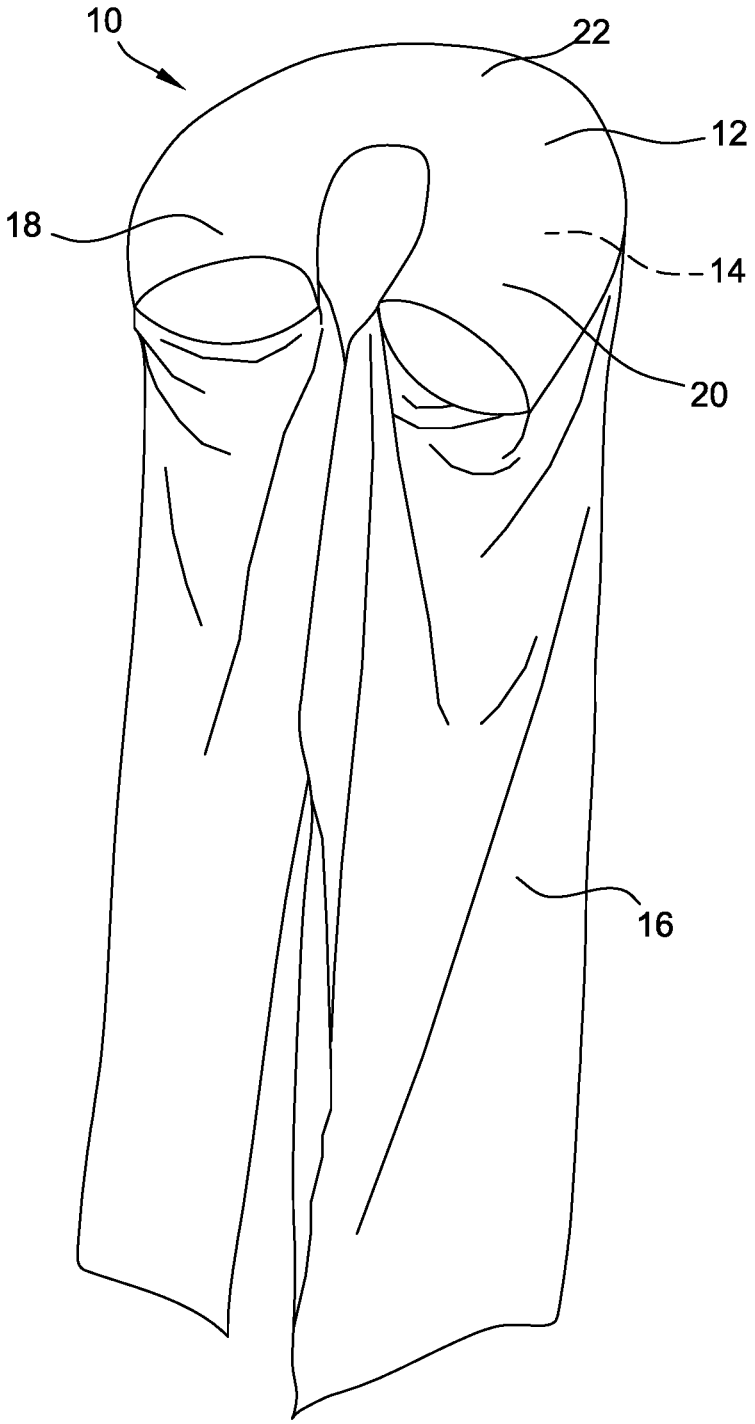
FIG. 1 is a perspective view of an example neck pillow with attached blanket sections.

With reference now to the accompanying drawings, and specifically to FIG. 1, a neck pillow according to one suitable embodiment of the present disclosure is illustrated and is indicated generally at 10. The neck pillow 10 includes a cover 12, stuffing 14, and a blanket 16 attached to the cover. The neck pillow 10 is arranged to provide support for a user's head and neck. For example, the neck pillow 10 is a U-shape. In other embodiments, the neck pillow 10 may have any suitable shape without departing from some aspects for the disclosure. For example and without limitation, in some embodiments, the neck pillow 10 may be any of the following shapes: crescent shape, rectangular prism, cuboid, disc, annular, and cylindrical.

The neck pillow 10 rests on the user's shoulders and wraps around their neck. The cover 12 and the stuffing 14 provide a soft comfortable structure that supports the head and neck, for example, while a user is sitting for extended periods of time. In addition, the blanket 16 optionally covers the user to facilitate the user warming up and protect the user from the environment.

Figure 2:
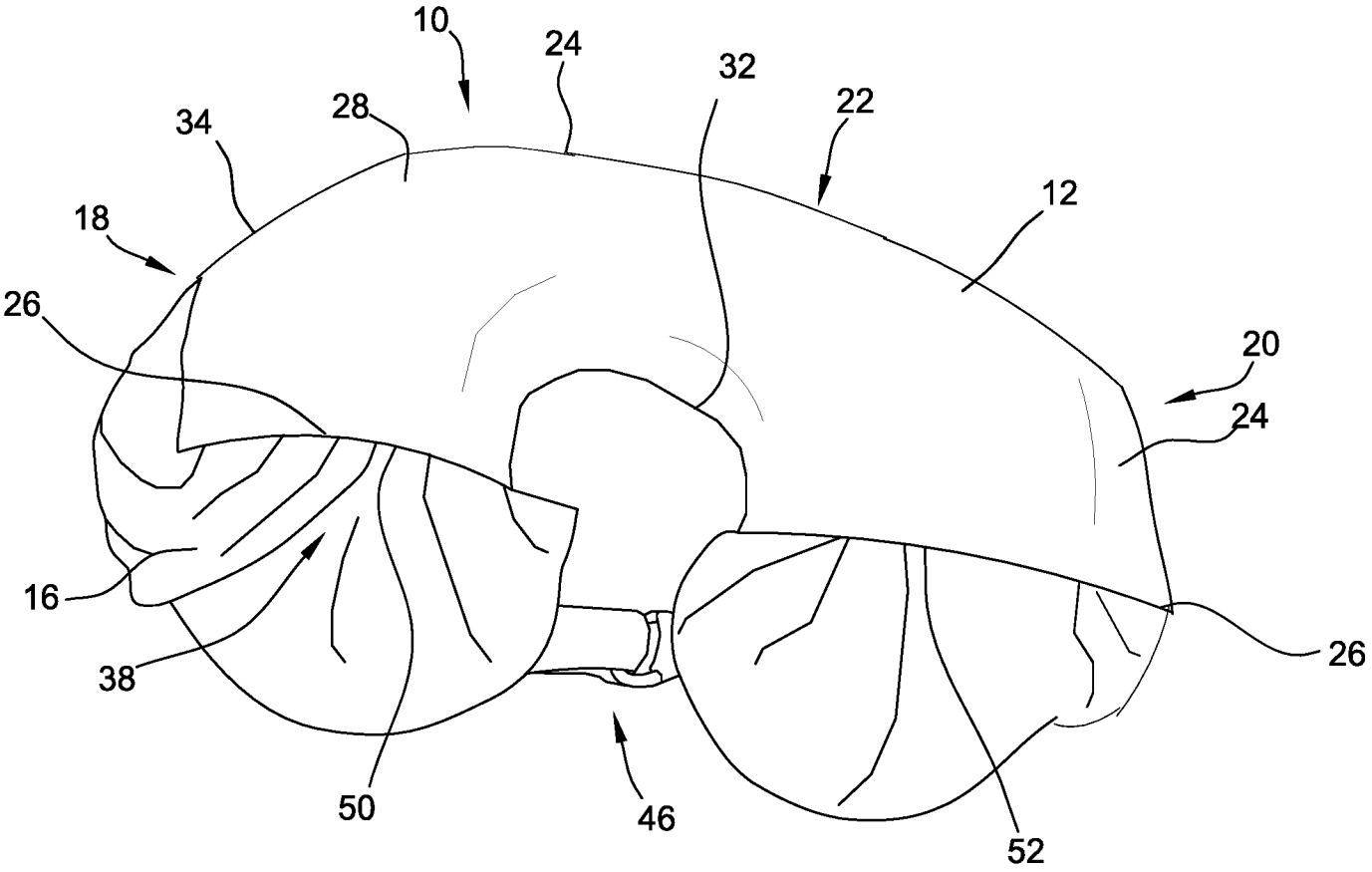
FIG. 2 is a perspective view of the neck pillow illustrating the attached blanket sections in a stowed position.

As seen in FIGS. 1 and 2, the blanket 16 of the neck pillow 10 is easily and quickly switched between a deployed or use position (shown in FIG. 1) and a stowed position (shown in FIG. 2). In the use position, the blanket 16 is arranged to extend from the cover 12 at the neck of the user and along and over the user's body. The blanket 16 may have a length that extends along the entire length of the person in the use position. For example, the blanket 16 may have a length of at least 3 feet. The blanket 16 may be provided in different sizes that accommodate different people. For example, the blanket 16 may be provided in adult sizes and children sizes. In the stowed position, the blanket 16 extends from an outer surface of the cover 12 and into an integrated storage compartment sized to receive the blanket through at least one opening.

Referring to FIGS. 1-7, the cover 12 is U-shaped and includes a first leg 18, a second leg 20, and a bend 22 connecting the first leg to the second leg. The first leg 18 and the second leg 20 each have a proximal end 24 joined to the bend 22 and a free distal end 26 opposite the proximal end. The first leg 18, the second leg 20, and the bend 22 collectively define a first compartment 36. The pillow 10 is shaped such that the legs 18, 20 of the cover 12 extend on either side of the neck and rest on the user's shoulders and the bend 22 extends around the back of the neck during use.

The pillow 10 is sized to extend around the neck of the wearer and support the head and neck of the wearer. For example, the pillow 10 can have an overall width in a range of 12 inches (in.) to 16 in. and an overall length in a range of 10 in. to 14 in. The pillow 10 has an overall thickness that is defined between the top 28 and the bottom 30. The thickness of the pillow 10 is different in the stowed position than the deployed position because the blanket 16 adds thickness to the pillow 10 in the stowed position. For example, the pillow 10 has a thickness in a range of 6 in. to 8 in. when the blanket 16 is in the stowed position (shown in FIG. 4). The pillow 10 has a thickness in a range of 4 in. to 5 in. when the blanket 16 is in the deployed position (shown in FIG. 3).

Figure 7:
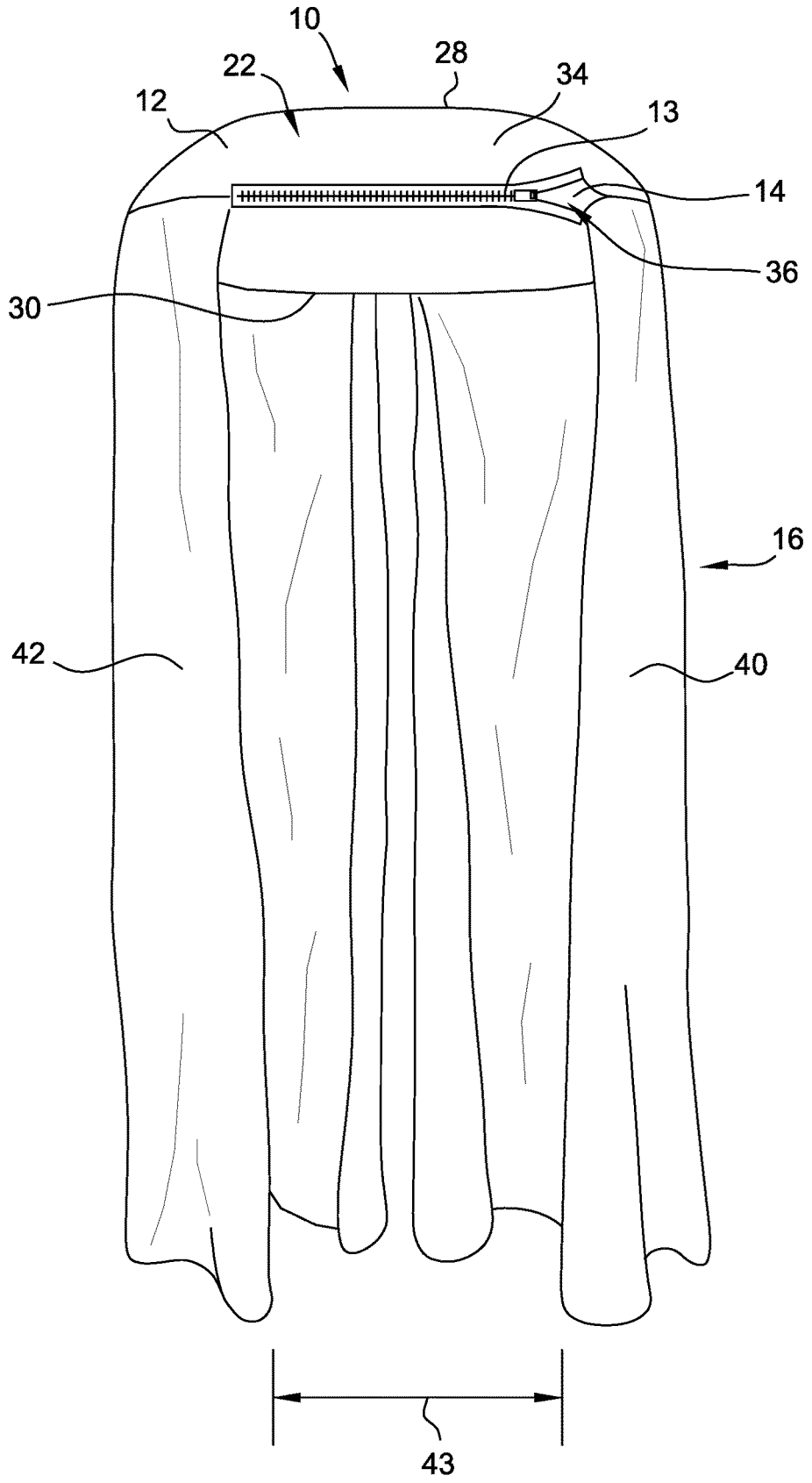
FIG. 7 is a back view of the neck pillow illustrating the attached blanket sections in the use position.

As seen in FIG. 7, the stuffing 14 is disposed within the first compartment 36. The stuffing 14 provides shape and volume to the neck pillow 10 and supports the user's head. For example, as seen in FIGS. 4-10, when the first compartment 36 is filled with the stuffing 14, the pillow 10 has a top 28, a bottom 30, a radially inward side 32, and a radially outward side 34. The sides 32, 34 are curved and extend between the top 28 and bottom 30. The radially inward side 32 is arranged to extend around and along the user's neck. The free distal ends of the first leg 18 and the second leg 20 extend between and connect the radially outward side 34 and the radially inward side 32.

Figure 8:
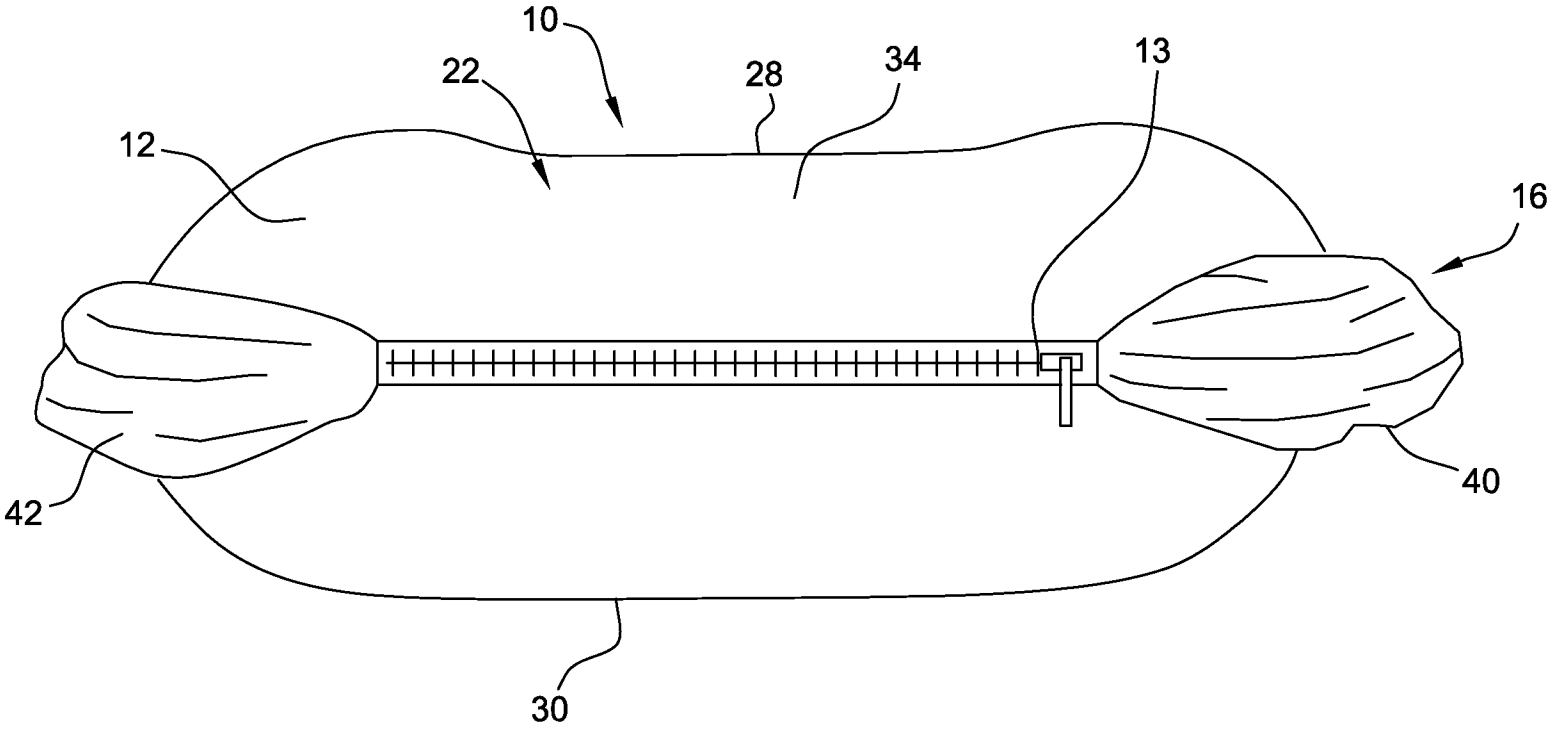
FIG. 8 is a back view of the neck pillow illustrating the attached blanket sections in the stowed position.

The stuffing 14 may include polyester, beads, pellets, foam, feathers, wool, hair, or any other suitable material. The stuffing 14 may be removable from the first compartment 36. For example, the cover 12 may include a resealable opening that facilitates removal of the stuffing 14 from the first compartment. The cover 12 may include one or more fasteners for selectively closing the resealable opening. For example, in the illustrated embodiment, the cover 12 includes a zipper 13 extending along the radially outward side 34 on the bend 22 of the cover 12, as seen in FIGS. 7 and 8. The zipper 13 on the bend 22 may have a length of 10 inches.

Figure 3:
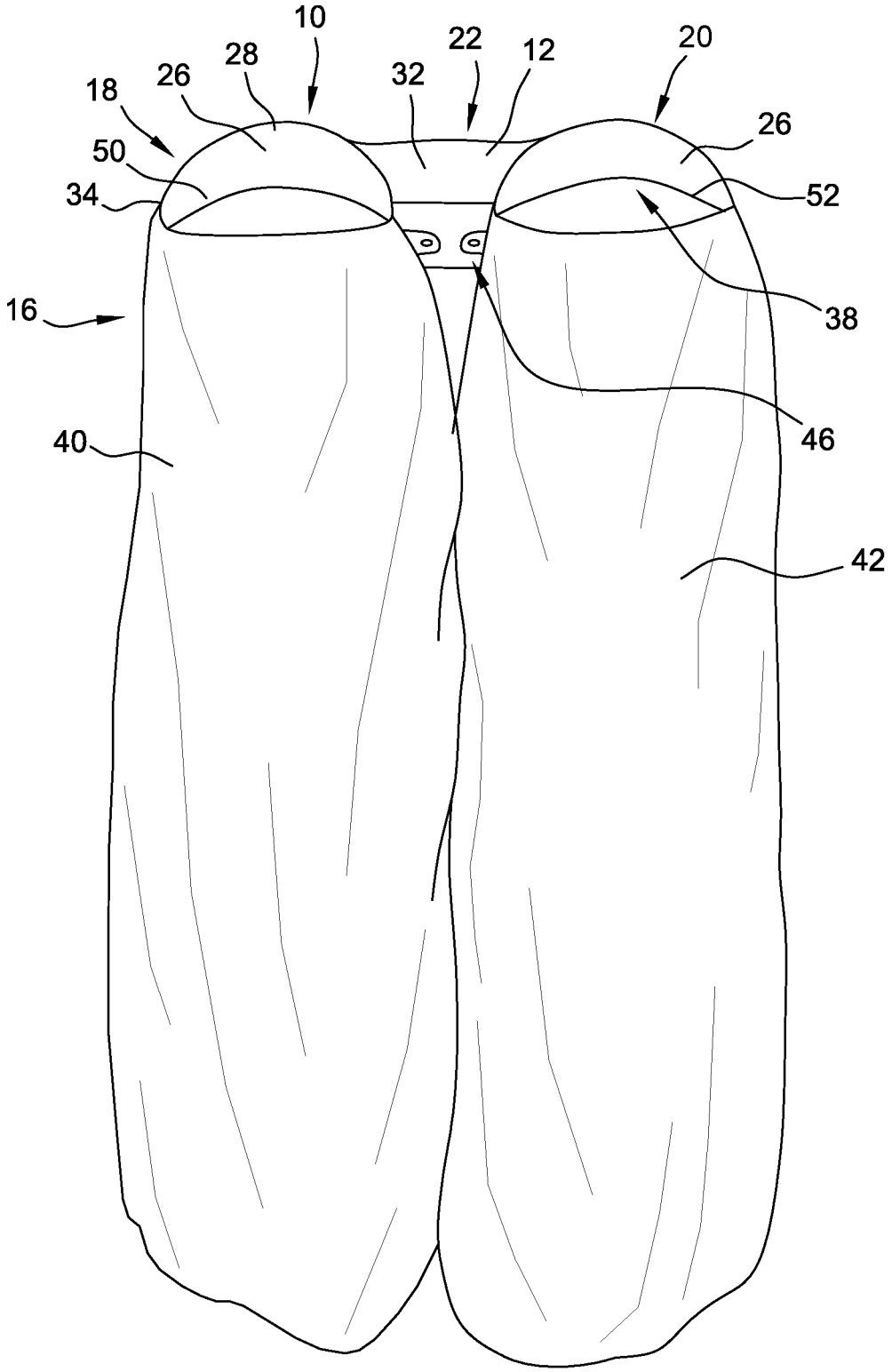
FIG. 3 is a front view of the neck pillow illustrating the attached blanket sections in a use position.
Figure 4:
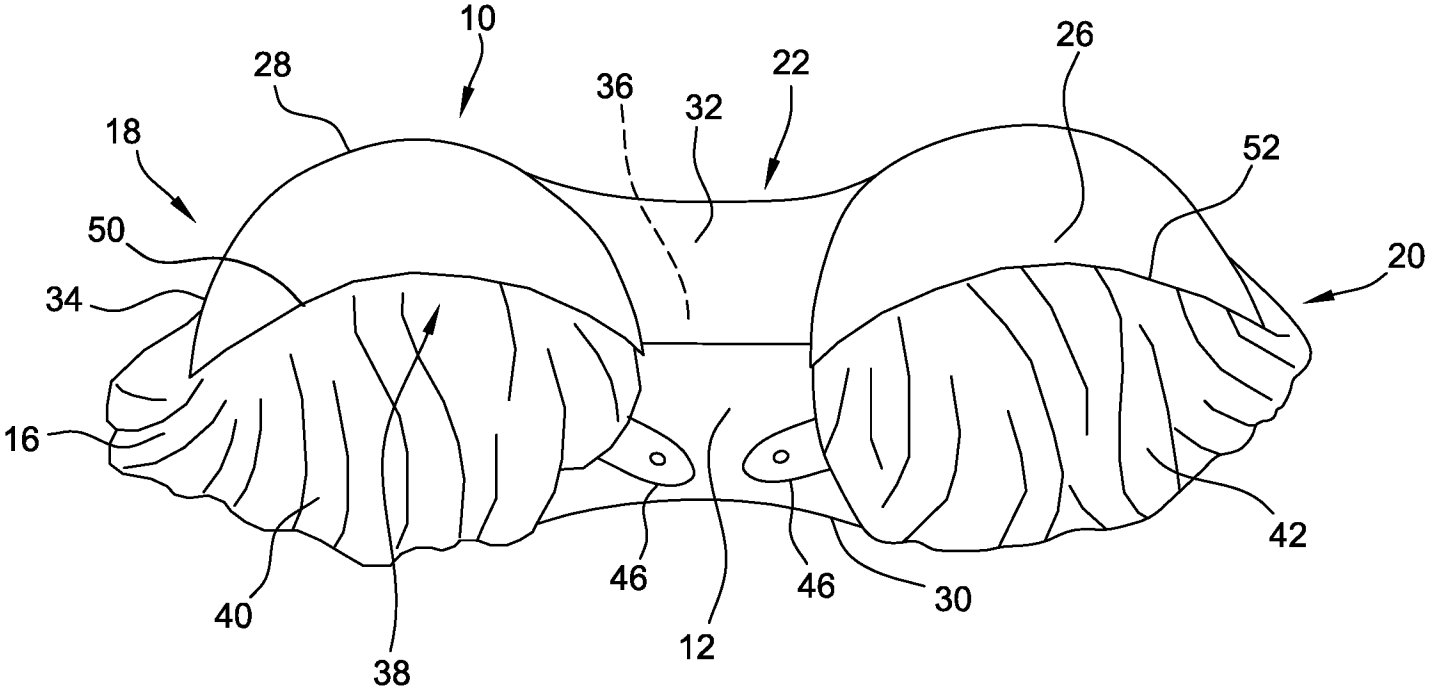
FIG. 4 is a front view of the neck pillow illustrating the attached blanket sections in the stowed position.
Figure 5:
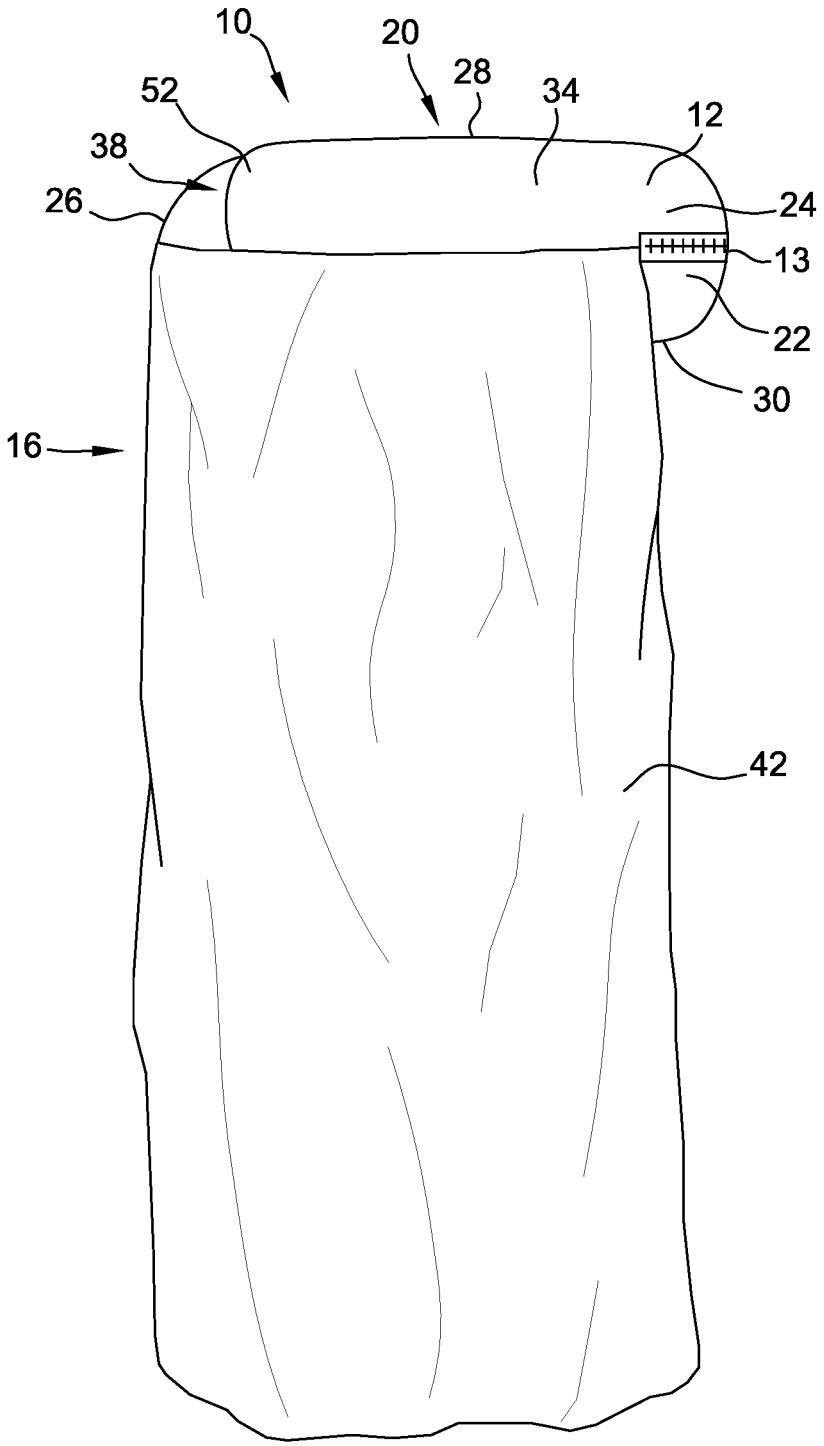
FIG. 5 is a side view of the neck pillow illustrating the attached blanket sections in the use position.
Figure 6:
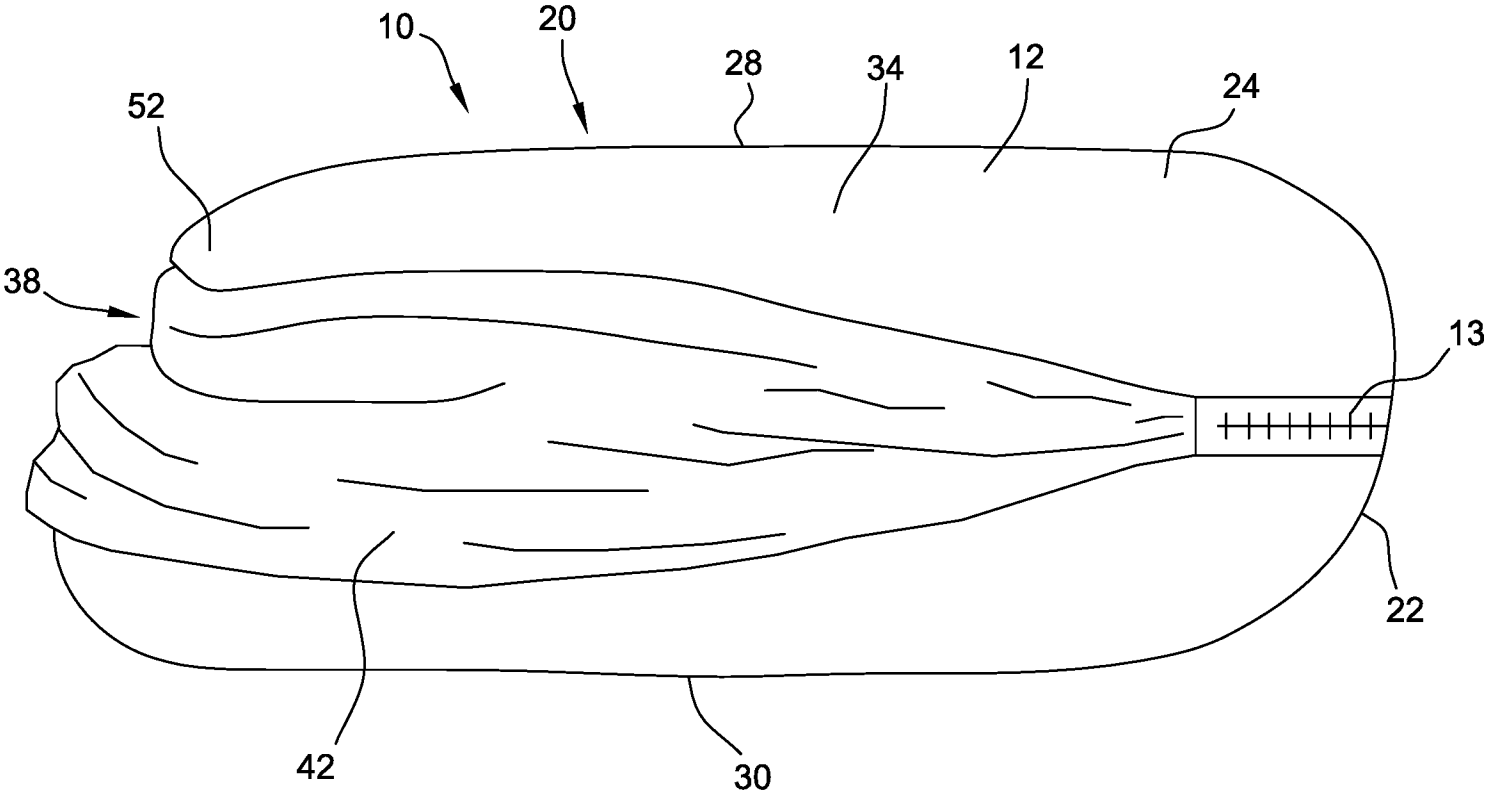
FIG. 6 is a side view of the neck pillow illustrating the attached blanket sections in the stowed position.

With reference to FIGS. 3, 5, and 7, the blanket 16 is joined to and extends from the radially outward side 34 of the pillow 10. The blanket 16 extends along the entire length of each of the legs 18, 20 and along at least a portion of the free distal ends of the first leg and the second leg. For example, the blanket 16 may be sewn into a seam of the cover 12 that extends along the radially outward side 34. Accordingly, the pillow 10 is arranged to provide improved support and comfort for a user and the pillow 10 is simpler to manufacture because the pillow 10 does not require additional fasteners to secure the blanket.

Figure 9:
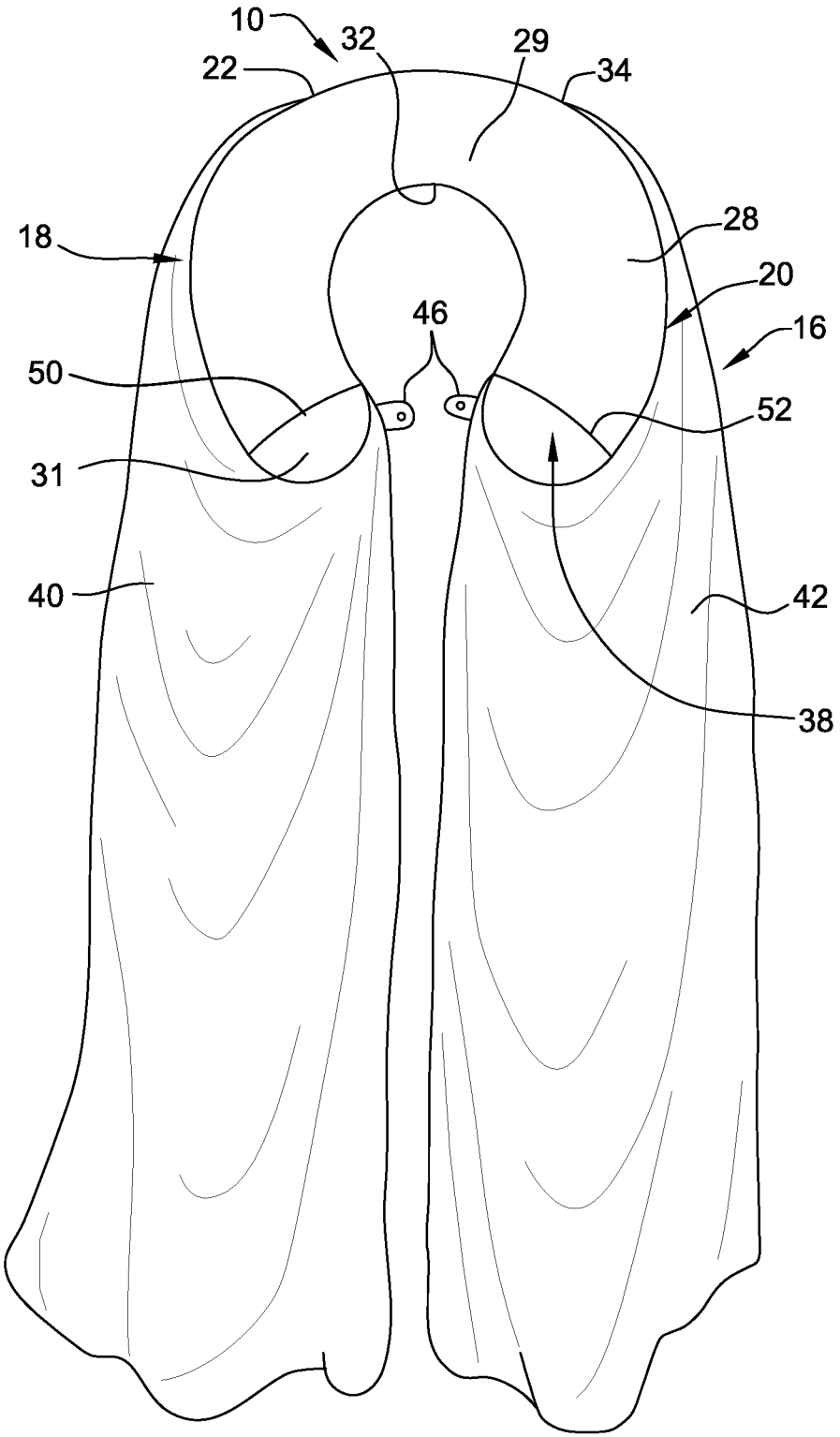
FIG. 9 is a top view of the neck pillow illustrating the attached blanket sections in the use position.

As illustrated in FIG. 9, the top 28 defines a second compartment 38. The second compartment 38 extends through the first leg 18, the second leg 20, and the bend 22. The second compartment 38 is sized to receive the blanket 16 in the stowed configuration. The second compartment 38 is U-shaped and has a single continuous interior volume (i.e., the second compartment 38 does not have barriers dividing the compartment into separate sections). Accordingly, the second compartment 38 facilitates the blanket 16 being positioned entirely within the second compartment in the stowed position. In some suitable embodiments, the second compartment 38 is divided and/or does not extend throughout the entirety of the top 28 of the cover 12.

The top 28 is configured to secure the blanket within the second compartment 38 without fasteners. For example, the top 28 includes an upper layer 29 and a lower layer 31. The upper layer 29 and the lower layer 31 are joined together to form a sleeve and define the second compartment 38. For example, the upper layer 29 and the lower layer 31 are sewn together along seams on the radially inward side 32 and the radially outward 34 of the pillow 10. At least the upper layer 29 is elastic and is biased toward the lower layer 31. Accordingly, the upper layer 29 and the lower layer 31 compress the blanket 16 within the second compartment 38. In addition, the upper layer 29 may be stretched away from the lower layer 31 to selectively expand the second compartment 38 and facilitate fitting the blanket 16 within the second compartment.

The second compartment 38 has a first opening 50 on the distal end 26 of the first leg 18 and a second opening 52 on the distal end 26 of the second leg 20. The first opening 50 and the second opening 52 are each sized to receive the blanket 16 and facilitate inserting the blanket 16 into the second compartment 38. In some embodiments, the cover 12 may include elastic members that extend at least partly around the first opening 50 and the second opening 52 to secure the blanket 16 within the second compartment. For example, elastic bands may be sewn into the cover 12 along the first opening 50 and the second opening 52 and arranged to bias the opening towards a closed position. In the illustrated embodiment, the cover 12 is constructed of an elastic material that contracts to secure the blanket 16 within the second compartment 38. In other embodiments, the cover 12 includes fasteners to selectively close the first opening 50 and the second opening 52. In some embodiments, the pillow 10 may have an opening on only one of legs 18, 20 and the blanket 16 may be inserted into the single opening and pushed throughout the second compartment 38.

Referring to FIGS. 7-10, the blanket 16 includes a first section or half 40 and a second section or half 42. The sections 40, 42 are separated by a gap 43 disposed on a rear of the cover 12. For example, the gap 43 extends along the entire bend 22 and has a width that is greater than a length of the zipper 13. The blanket 16 is simpler and quicker to stow within the second compartment 38 because the blanket 16 is divided into the sections 40, 42. In addition, the gap 43 is disposed on a rear of a wearer to facilitate the blanket 16 extending around the wearer without the blanket 16 being trapped behind the wearer when the wearer is in a prone or sitting position.

Suitably, the sections 40, 42 are equal in length and width to each other and are sized to cover the wearer. For example, each section 40, 42 can have a width in a range of 24 inches (in.) to 36 in. and a length in a range of 30 in. to 48 in.

Figure 11:
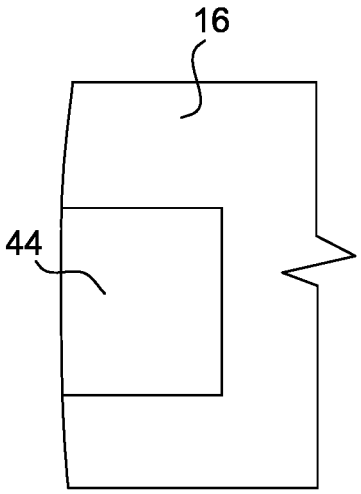
FIG. 11 is an enlarged view of a portion of the attached blanket illustrating a pocket of the attached blanket.

FIG. 11 is an enlarged view of a portion of the attached blanket 16 illustrating a pocket 44 of the attached blanket. The blanket 16 may include any suitable pockets 44 and/or the pockets 44 may be omitted without departing from some aspects of the disclosure. In the example, each pocket 44 is made of the same material as the blanket 16 and, for example, is sewn onto the blanket on three sides of the pocket with one end open at the top of the pocket. Each pocket 44 is suitably sized to receive the wearer's hands and/or objects such as a phone or electronic device.

Figure 10:
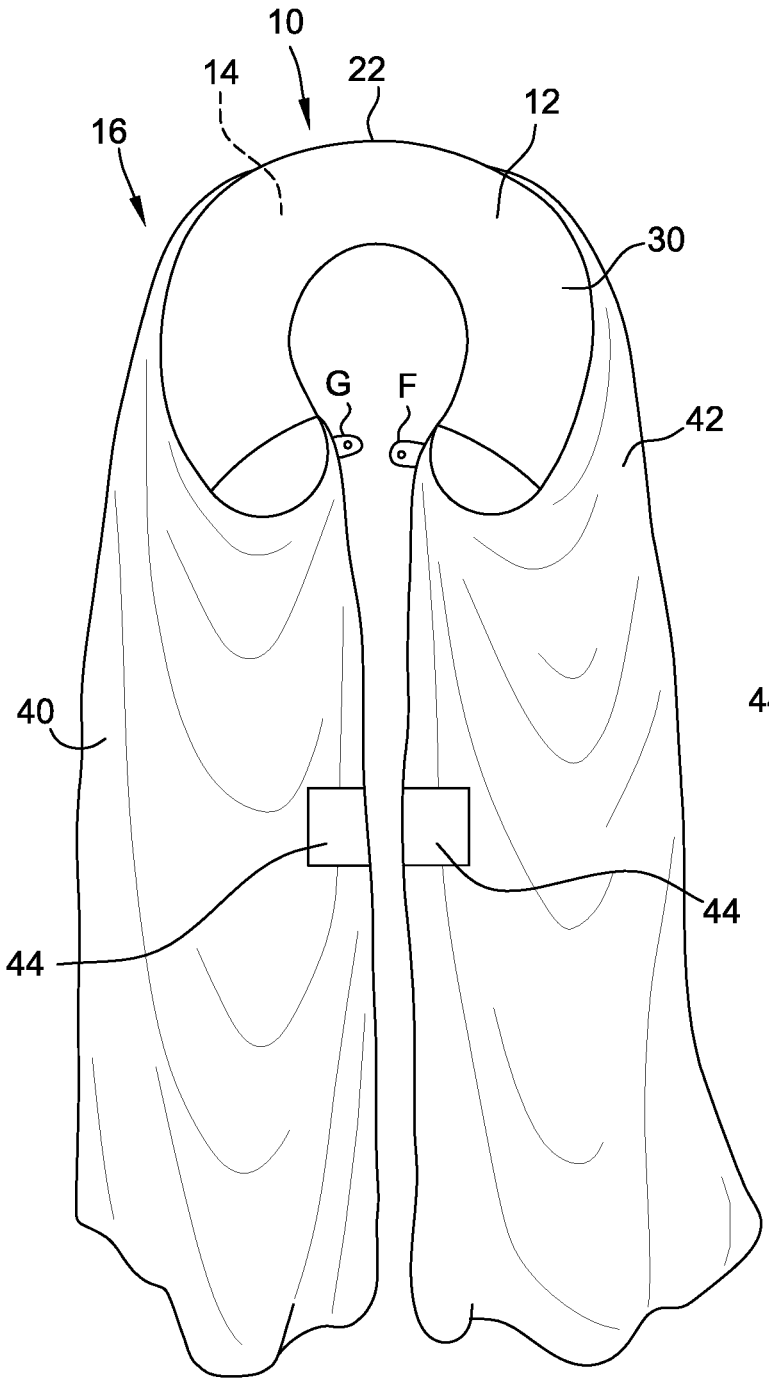
FIG. 10 is a bottom view of the neck pillow illustrating the attached blanket sections in the use position.

As shown in FIGS. 10 and 11, the blanket 16 includes two of the pockets 44. The pockets 44 are located on the inside of the blanket 16 (i.e., the side of the blanket 16 facing towards the wearer during use) such that the wearer can access the pockets when the blanket 16 is wrapped around the wearer. The pockets 44 are located along edges of the blanket 16 that extend downward from the distal ends of the legs 18, 20. Suitably, the pockets 44 are positioned at a location on each section that facilitates the wearer positioning their hands within the pockets and wrapping the blanket 16 around themselves. For example, the pockets 44 are spaced from the cover 12 a distance that is at least one third of the length of the blanket 16 and no more than half the length of the blanket 16.

Figure 12:
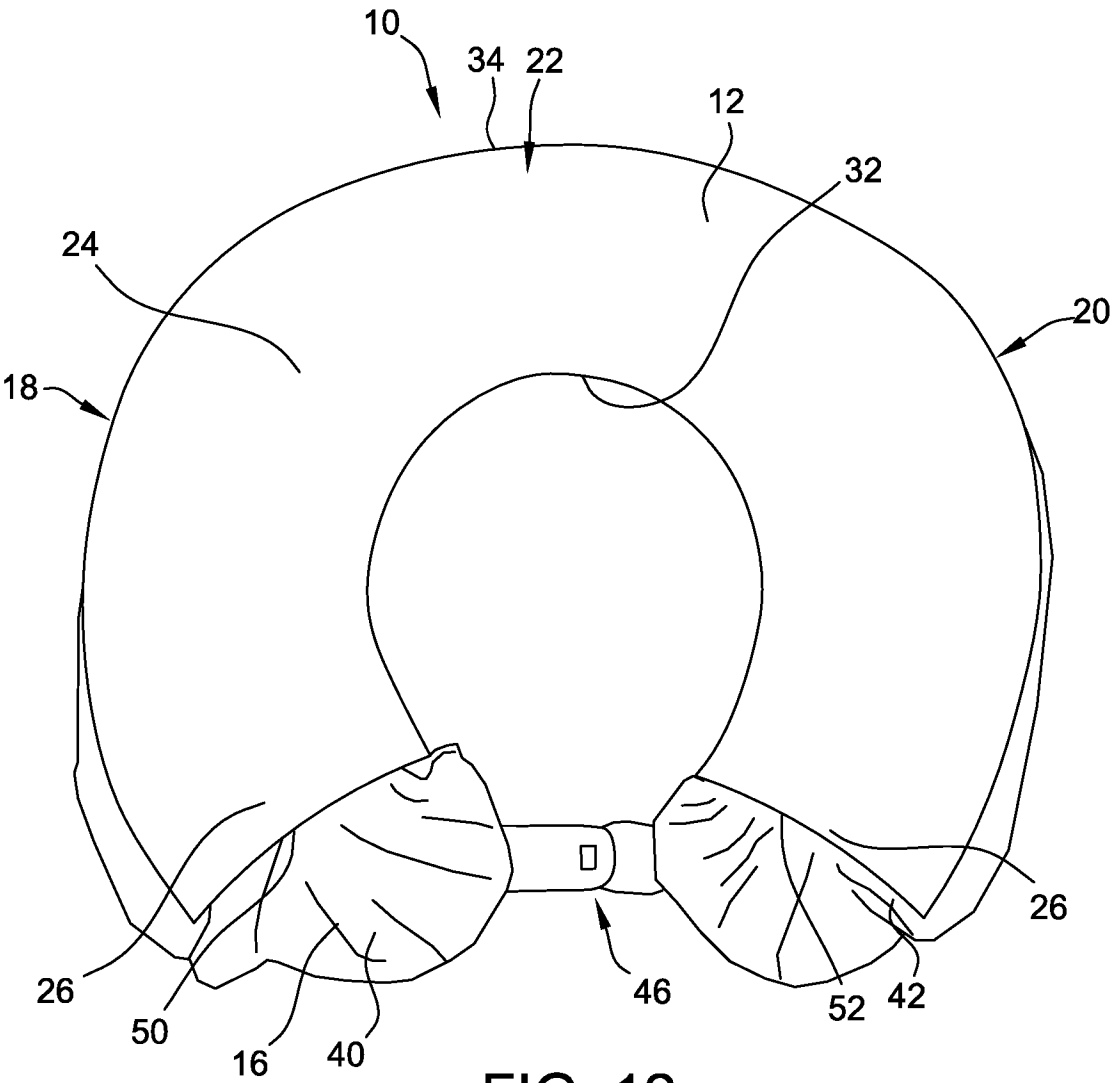
FIG. 12 is a top view of the neck pillow illustrating the attached blanket sections in the stowed position.

FIG. 12 is a top view of the neck pillow 10 illustrating the attached blanket sections 40, 42 in a stowed position. In the stowed position, each section 40, 42 of the blanket extends from the radially outward side 34 on the respective leg 18, 20 through the opening 50, 52 on the distal end of the respective leg and into the second compartment 38. The neck pillow 12 has a compact shape and is easily transported in the stowed position. In addition, the cover 12 has a fastener 46 that connects the distal ends of the legs 18, 20 together and secures the neck pillow 10 in the U-shape. For example, the fastener 46 includes a first engagement member (e.g., a button or snap) on the first leg 18 that is arranged to engage a second engagement member on the second leg 20. In suitable embodiments, the fastener 46 may be omitted without departing from some aspects of the disclosure.

The neck pillow 10 with attached blanket 16 is made from a soft and comfortable material. For example, at least a portion of the cover 12 may be elastic to facilitate securing the blanket 16 within the second compartment 38. For example, the cover 12 may be constructed of a material that includes at least 5% spandex. Suitably, the cover 12 includes a mixture of polyester (e.g., 90% to 96% polyester) and spandex (e.g., 4% to 10% spandex). In the example, the blanket 16 is the same material as the cover 12 to simplify manufacture and cleaning of the pillow 10. The material of the cover 12 and the blanket 16 is comfortable, warm, durable, easy to clean, and facilitates the blanket 16 being positioned within the second compartment. The pillow 10 may include other materials without departing from some aspects of the disclosure. For example, the pillow 10 may include any of the following materials: faux fur, fleece, cotton, spandex, polyester, and combinations of these materials.

Described herein are embodiments of a neck pillow. For example, the neck pillow has a U-shape and includes an attached blanket. The blanket is divided into two sections. A singular pocket extending around the top of the U-shape pillow is open on each end and forms a stuffable compression pocket that holds each section of blanket. The blanket sections are attached to each side of U-shape and can be removed from the pocket and positioned to cover the user. Each blanket section has a hand-pocket on an underside that helps a user to wrap the sections around them and overlap the sections to act as a larger blanket. The neck pillow is arranged for use by both children and adults and accommodates multiple sizes of people.

The neck pillow has a bend and legs with an opening on each end and may have an elastic band sewn around the openings. Each blanket section is attached to outer edges of the pillow and extends from an inside corner of the distal end of a leg to the proximal end of the respective leg. A zipper is located on back-edge of U-shape pillow for selectively removing stuffing from inside a cover of the pillow. Accordingly, the neck pillow is an all-encompassing apparatus that provides the benefits of a pillow and a blanket as one item.

Embodiments of the present disclosure provide a neck pillow that is easy to carry and that provides support to the neck and head. The neck pillow is comfortable and supportive. In addition, the attached blanket may be quickly and easily deployed from the travel pillow by removing the blanket through the openings on the distal ends of the pillow and the sections of the blanket. The blanket is connected to the pillow to prevent the blanket being displaced during use and facilitate transporting the pillow and the blanket without them becoming separated. Moreover, the blanket is quick and easy to stow because the blanket is received in the U-shaped compartment through the openings on the distal ends. Also, the compartment is constructed of an elastic material that facilitates securing the blanket within the compartment and facilitates expanding the openings for inserting and removing the blanket through the openings. Accordingly, the neck pillow may not require potentially uncomfortable fasteners or securement mechanisms on the legs or inner edges of the neck pillow or on the blanket. In addition, the stuffing may be removed for cleaning, and the cover and the blanket may be washed as a single unit because the blanket is securely attached to the cover.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the disclosure, it is intended that all matter contained in the above description and shown in the accompanying drawings shall be interpreted as illustrative and not in a limiting sense. Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Regardless of whether shown and described in combination or separately, the various features (both structural and methodological) are intended to be selectively included or omitted to produce an embodiment with a particular set of features. In addition, each of the operations described above may be executed in any order. For example, one operation may be performed before another operation. Additionally, one or more of the disclosed operations may be performed simultaneously or substantially simultaneously.

What is claimed is:

1. A pillow comprising:

a cover having a first leg, a second leg, and a bend connecting the first leg to the second leg, wherein the first leg and the second leg each have a proximal end joined to the bend and a free distal end opposite the proximal end, wherein the first leg, the second leg, and the bend collectively form a U-shape and define a first compartment and a second compartment, wherein the free distal end of at least one of the first leg and the second leg defines at least one opening into the second compartment, wherein the at least one opening comprises a first opening at the free distal end of the first leg and a second opening at the free distal end of the second leg, wherein the blanket comprises a first section attached to the first leg and a second section attached to the second leg, and wherein the second compartment is sized to receive the first section through the first opening on the free distal end of the first leg, and the second section through the second opening on the free distal end of the second leg;

stuffing disposed within the first compartment and extending through the first leg, the second leg, and the bend; and a blanket attached to the cover, wherein the blanket has a stowed position in which the blanket extends from an outer surface of the cover and into the second compartment through the first and second openings, wherein the second compartment is sized to receive the blanket in the stowed position.

2. A pillow in accordance with claim 1, wherein the cover is a constructed of a material including spandex that is elastic and secures the blanket within the second compartment without fasteners.

3. A pillow in accordance with claim 1, wherein the cover has a top, a bottom, a radially outward side, and a radially inward side, wherein the second compartment is on the top of the cover and the blanket is attached to the radially outward side of the cover.

4. A pillow in accordance with claim 3, wherein the blanket is attached to the cover along the entire length of the radially outward side.

5. A pillow in accordance with claim 4, wherein free distal ends of the first leg and the second leg extend between the radially outward side and the radially inward side, and wherein the blanket is attached to the cover along at least a portion of the free distal ends of the first leg and the second leg.

6. A pillow in accordance with claim 1, wherein the cover includes an elastic member extending around each of the first and second openings and arranged to bias the first and second openings towards a closed position.

7. A pillow in accordance with claim 1, wherein the blanket includes a pocket.

8. A pillow in accordance with claim 1, the bend of the cover defines a third opening, and wherein the pillow is removable from the first compartment through the third opening on the bend of the cover.

9. A pillow in accordance with claim 1 further comprising fasteners disposed on the free distal ends of the first and second legs and arranged to secure the pillow around a neck.

10. A pillow comprising:

a cover including a top, a bottom, and sides extending between the top and the bottom, wherein the cover is U-shaped and the top, the bottom, and the sides collectively define a first compartment, and wherein the top defines a second compartment, wherein the cover has a first leg, a second leg, and a bend forming the U-shape of the cover;

stuffing disposed within the first compartment; and a blanket attached to the sides of the cover, wherein the blanket has a stowed position in which the blanket extends from the sides of the cover and into the second compartment, wherein the second compartment is sized to receive the blanket in the stowed position, wherein the blanket extends from an outer surface of the cover and into the second compartment through an opening on a free distal end of the first leg in the stowed position.

11. A pillow in accordance with claim 10, wherein the blanket is attached to the cover throughout the entire extension of the first leg.

12. A pillow in accordance with claim 10, wherein the sides comprise a radially outward side and a radially inward side, wherein the blanket is attached to the radially outward side of the cover.

13. A pillow comprising:

a top;

a bottom;

sides extending between the top and the bottom, wherein the top, the bottom, and the sides collectively defining a first compartment sized to receive stuffing, wherein the top defines a second compartment;

a cover having a first leg, a second leg, and a bend forming a U-shape of the cover; and a blanket attached to the sides, wherein the blanket has a stowed position and a use position, wherein the second compartment is sized to receive the blanket in the stowed position, wherein the blanket is configured to extend from an outer surface of the cover and into the second compartment through an opening on a free distal end of the first leg;

wherein the top is a constructed of a material that includes spandex and is elastic, the top configured to secure the blanket within the second compartment without fasteners.

14. A pillow in accordance with claim 13, wherein the pillow is U-shaped, the sides comprising a radially outward side and a radially inward side, wherein the blanket is attached to the radially outward side of the pillow.

15. A pillow in accordance with claim 13, wherein the blanket includes a first blanket section and a second blanket section, wherein the first blanket section and the second blanket section are separated by a gap.

* * * * *